US006172943B1

(12) United States Patent
Yuzuki

(10) Patent No.: US 6,172,943 B1
(45) Date of Patent: Jan. 9, 2001

(54) ELECTRONIC CLOCK HAVING AN ELECTRIC POWER GENERATING ELEMENT

(75) Inventor: Toshiyuki Yuzuki, Chiba (JP)

(73) Assignee: Seiko Instruments Inc. (JP)

( * ) Notice: Under 35 U.S.C. 154(b), the term of this patent shall be extended for 0 days.

(21) Appl. No.: 09/167,436

(22) Filed: Oct. 6, 1998

(30) Foreign Application Priority Data

Oct. 7, 1997 (JP) ..... 9-274410
Oct. 8, 1997 (JP) ..... 9-276224
Jul. 21, 1998 (JP) ..... 10-204731

(51) Int. Cl.[7] ..... G04B 1/00; G04C 3/00
(52) U.S. Cl. ..... 368/204; 368/205
(58) Field of Search ..... 368/203–205

(56) References Cited

U.S. PATENT DOCUMENTS 5,705,770 * 1/1998 Ogasawara et al. ..... 368/204
5,740,132 * 4/1998 Ohshima et al. ..... 368/204
5,889,734 * 9/1999 Sato ..... 368/64

* cited by examiner

*Primary Examiner*—Vit Miska
(74) *Attorney, Agent, or Firm*—Adams & Wilks

(57) ABSTRACT

An Electronic clock having an electric power generating element which is operable even in a state where the voltage of the electric power generating element is low. The electronic clock includes an electric power generating element, a low-voltage oscillating circuit which can oscillate even with a low voltage with the electromotive force developed by the electric power generating element as a power supply, an electronic clock movement having signal generating means, a voltage detecting circuit that detects an output voltage of a charging circuit, a selecting circuit that selects any one of the output signal of the low-voltage oscillating circuit and the output signal of the signal generating means on the basis of the voltage detection result to output it, and a step-up circuit that inputs an output signal of the selecting circuit and a voltage from the electric power generating element for stepping it up to output a stepped-up voltage to the charging circuit.

6 Claims, 9 Drawing Sheets

ELECTRONIC CLOCK HAVING AN ELECTRIC POWER GENERATING ELEMENT

BACKGROUD OF THE INVENTION

1. Field of the Invention

The present invention relates to an electronic clock having an electric power generating element, and particularly to an electronic clock which can be driven even when the electromotive force of the electric power generating element is small. More particularly, the present invention relates to an electric clock in which an improvement of an electronic clock to reduce a current consumption of the peripheral circuit of the electric power generating element is performed.

2. Description of the Related Art

Up to now, it has been known that an electric power generating element consisting of a thermoelectric element or a solar battery has been employed as an electric power generating element of an electronic clock. FIG. 2 shows a block diagram of a conventional electronic clock having an electric power generating element. This is an example in which the thermoelectric element is employed as the electric power generating element. A charging circuit 204 charges by an electromotive force (voltage) obtained by a thermoelectric element 201. An electronic clock movement 202 is made up of an oscillating circuit 202*a*, a dividing circuit 202*b* and time display means 202*c* at the least as structural elements and driven by the voltage charged in the charging circuit 204. A step-up circuit 203 inputs the voltage output by the charging circuit 204 and outputs a voltage stepped up by a clock oscillated by the oscillating circuit 202*a* to a circuit such as the time display means 202*c*, which requires a higher drive voltage than that required by the oscillating circuit or the dividing circuit.

The above-described conventional electronic clock having the electric power generating element requires, as the electromotive force of the electric power generating element, a voltage sufficient for making the circuits of the electronic clock acting as loads operative. This necessary voltage is normally about 0.6 to 1 V. Also, in order to maintain the operation of the electronic clock even when the electronic clock is located in an environment where the electric power generating element cannot generate an electric power, the electromotive force of the electric power generating element is charged in the charging circuit.

However, since the above-described conventional electronic clock having the electric power generating element requires about 0.6 to 1 V or more as the electromotive force of the electric power generating element, a large number of electric power generating elements must be connected in series in order to obtain the electromotive force. This leads to an increase in its area and volume, resulting in a problem when the large number of electric power generating elements are mounted on a small-sized electronic device (for example, an electronic clock).

Also, the clock could not be driven until an output voltage of the charging circuit such as a capacitor or a secondary battery is charged up to a voltage at which the clock can be driven. The electric power generating element converts an external energy such as a light or heat into an electric energy. However, if little difference in luminance, temperature or the like is obtained, it takes time to charge the charging circuit. For that reason, when the charging circuit is allowed to be charged from a state where there is no capacitance (voltage) in the charging circuit, it takes a long time until the clock starts to operate (hereinafter called as "oscillation start time").

SUMMARY OF THE INVENTION

In order to solve the above problems, an electronic clock according to a first aspect of the present invention is designed to include a low-voltage oscillating circuit which can oscillate even when an electromotive force developed by an electric power generating element is of a low voltage, a step-up circuit which inputs an output signal of the low-voltage oscillating circuit for stepping up the output signal, and a charging circuit for charging a stepped-up voltage, in which the electronic clock is driven by the voltage charged in the charging circuit.

Also, in an electronic clock according to a second aspect of the present invention, a voltage detecting circuit detects the electromotive force (voltage) charged in the charging circuit, and when the voltage detecting circuit detects a voltage equal to or higher than a voltage at which an oscillating circuit within an electronic clock movement oscillates, the drive of the low-voltage oscillating circuit stops, to thereby reduce the current consumption of the low-voltage oscillating circuit. Simultaneously, a selecting circuit changes over from an input clock of the step-up circuit to a clock of signal generating means (for example, the oscillating circuit, a dividing circuit or the like) within the electronic clock movement (in particular, a clock IC) so that the electromotive force (voltage) developed by the electric power generating element is stepped up and charged in the charging circuit.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERED EMBODIMENT (First Embodiment Mode)

Figure 1:
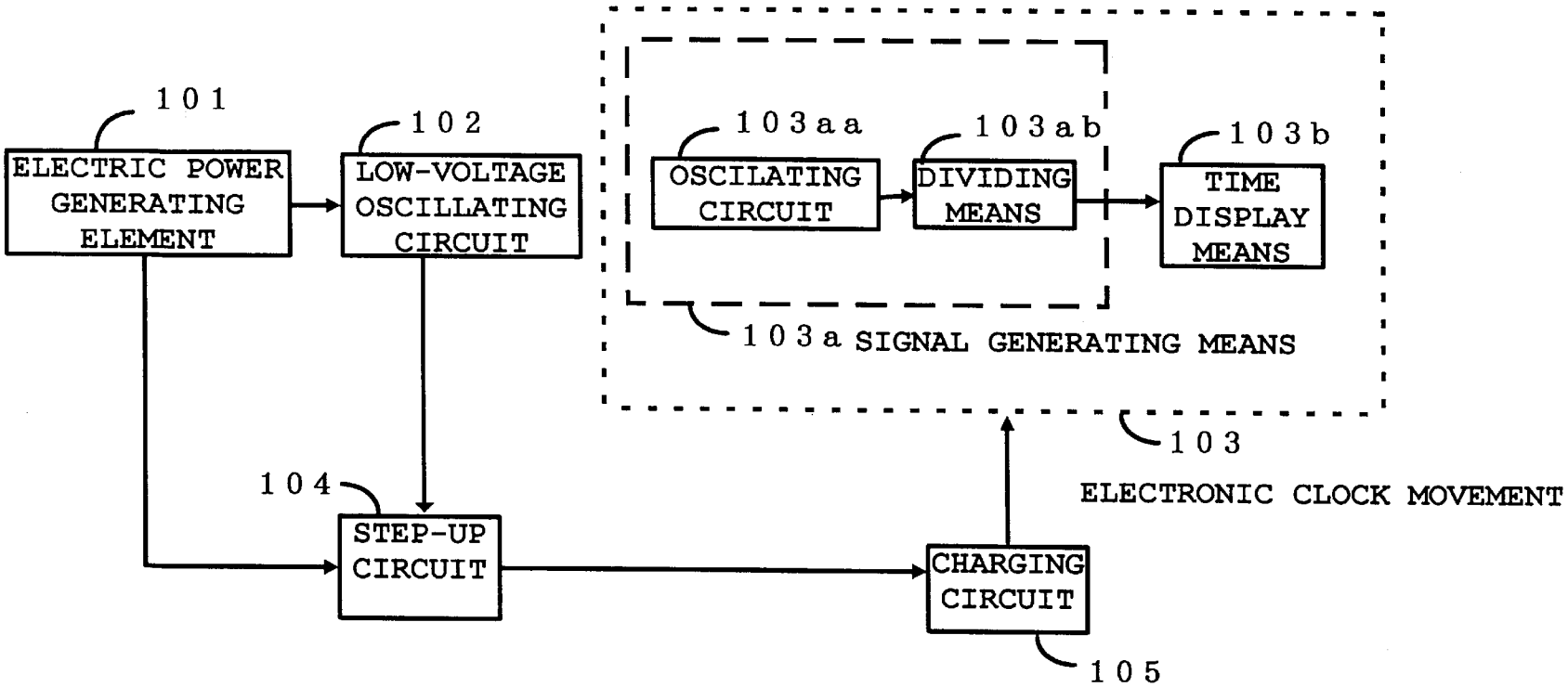
FIG. 1 is a block diagram showing an electronic clock having an electric power generating element in accordance with a first embodiment mode of the present invention.
Figure 2:
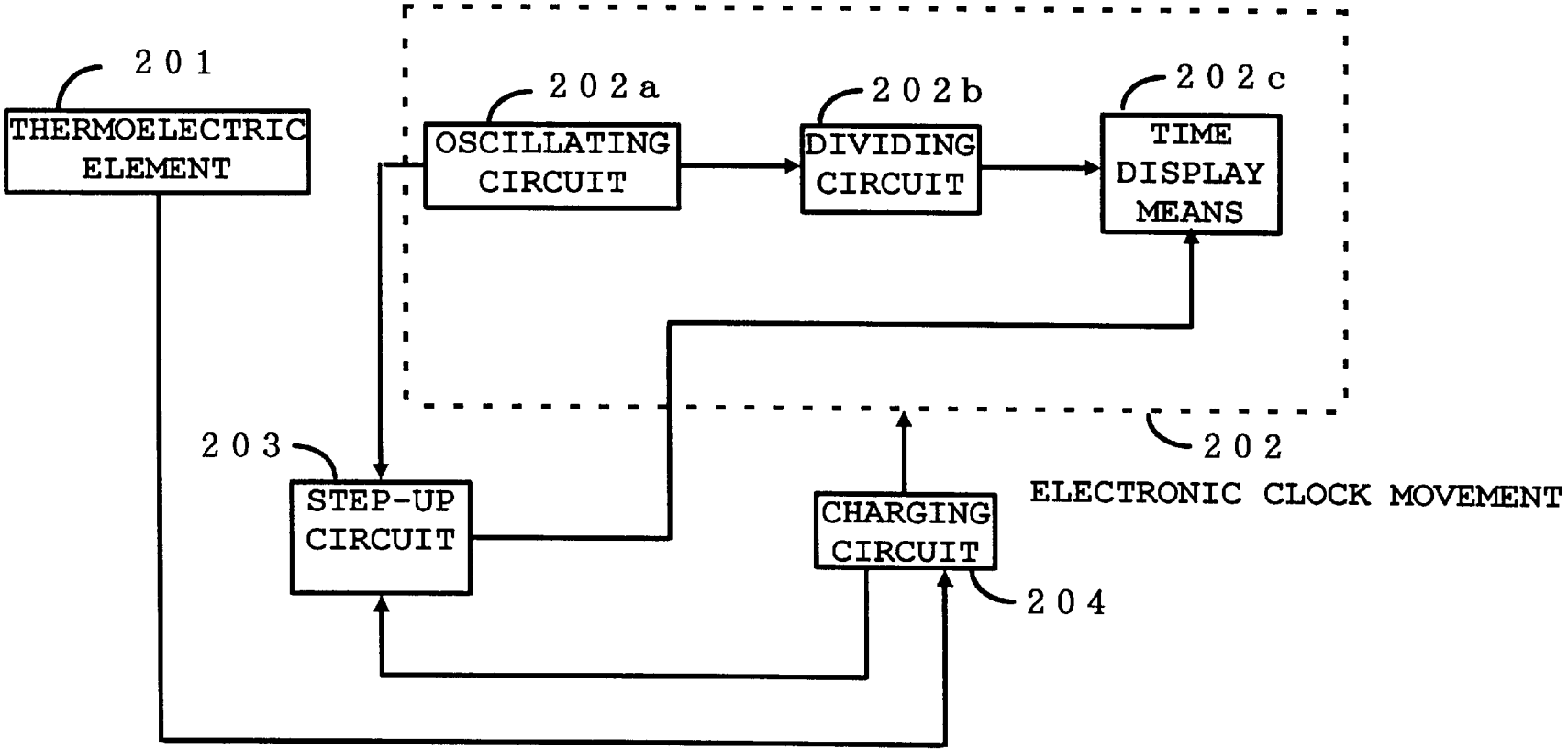
FIG.2 Prior Art
FIG. 2 is a block diagram showing a conventional electronic clock having a thermo-element.

An electronic clock having an electric power generating element in accordance with a first embodiment of the present invention will be described. FIG. 1 is a block diagram showing that electronic clock.

The electronic clock is made up of an electric power generating element 101 that generates an electric power by light, heat, etc.; an electronic clock movement 103 including a low-voltage oscillating circuit 102 that oscillates by a low-voltage output of the electric power generating element 101, signal generating means 103*a* having an oscillating circuit 103*aa* and dividing means 103*ab,* and time display means 103*b* that displays time on the basis of an output signal of the signal generating means 103*a;* a step-up circuit 104 that inputs an output voltage of the electric power generating element 101 and an output signal of the low-voltage oscillating circuit 102 for stepping up the output voltage of the electric power generating element 101 to a predetermined voltage to output a step-up voltage to a charging circuit 105; and the charging circuit 105 such as a capacitor or a secondary battery which charges an electromotive force therein to output an output voltage to the electronic clock movement 103.

Figure 3:
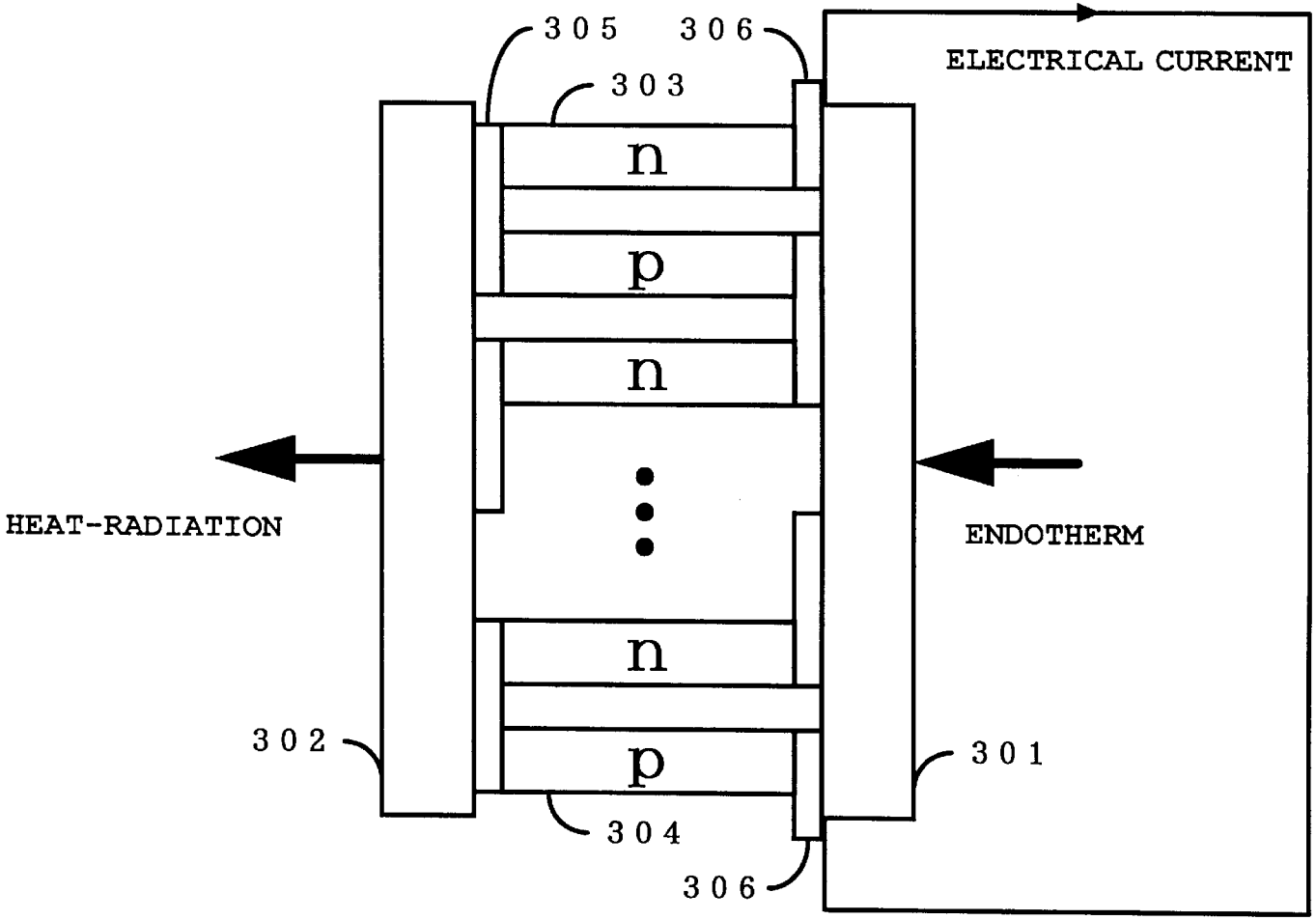
FIG. 3 is a structural explanatory diagram showing the structure of a thermo-element and an electric power generating principle.

As the electric power generating element 101, there is used a thermo-element including a plurality of n-type semiconductors and p-type semiconductors connected in series to each other, endothermic-side insulators fixed on every two nodes of the n-type semiconductors and the p-type semiconductors, and heat-radiating-side insulators fixed on other every other two nodes of the n-type semiconductors and the p-type semiconductors as shown in FIG. 3. The electric power generating element 101 may be comprised of a thermo-element including at least a pair of n-type semiconductor and p-type semiconductor elements connected in series.

Also, the electric power generating element 101 may be comprised of another electric power generating element such as a solar battery other than the above-described thermo-element.

(Second Embodiment Mode)

Figure 6:
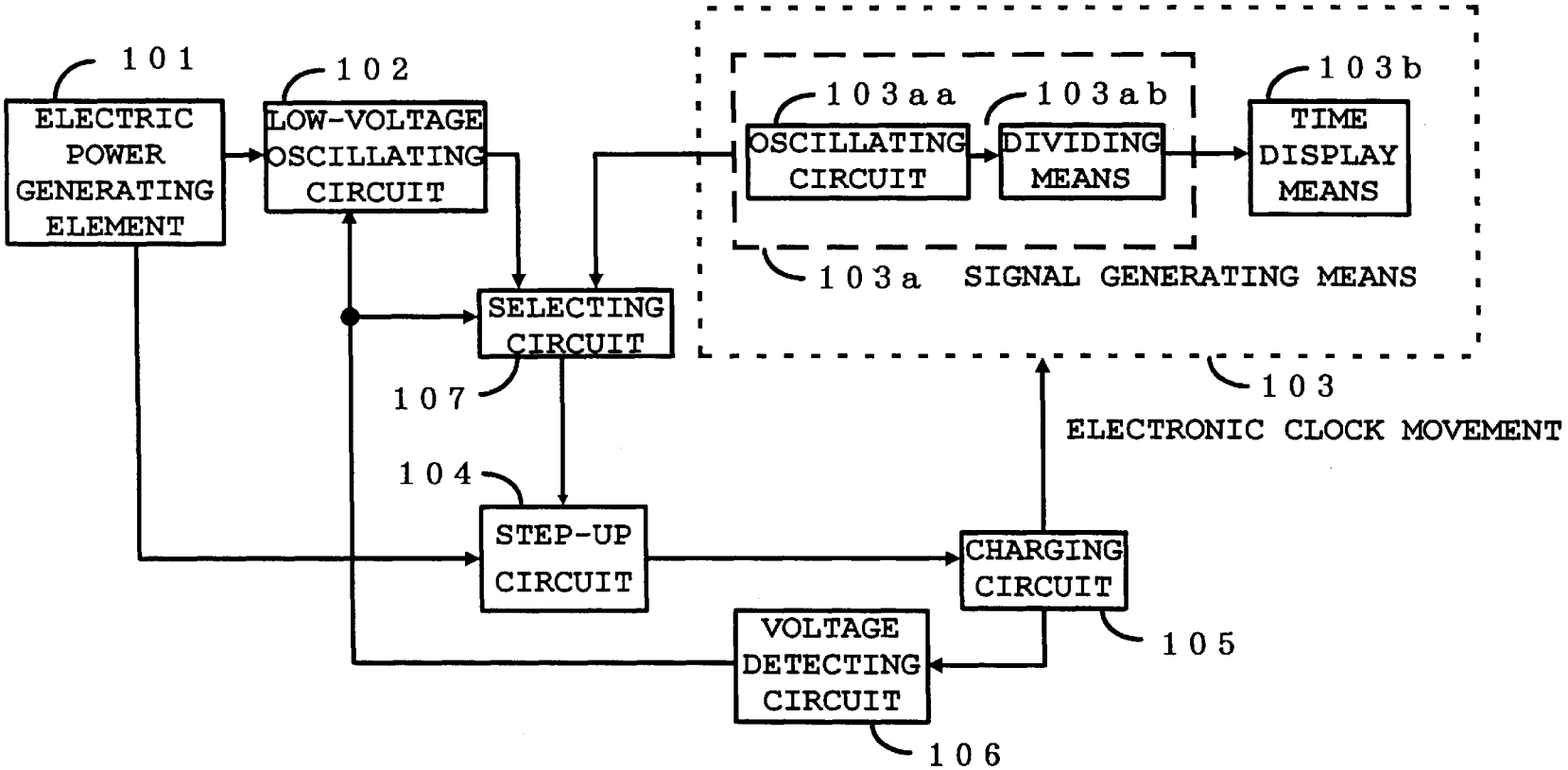
FIG. 6 is a block diagram showing an electronic clock having an electric power generating element in accordance with a second embodiment mode of the present invention.

Subsequently, an electronic clock having an electric power generating element in accordance with a second embodiment of the present invention will be described. FIG. 6 is a block diagram showing that electronic clock.

The electronic clock is made up of an electric power generating element 101 that generates an electric power by a light, a heat or the like; an electronic clock movement 103 including a low-voltage oscillating circuit 102 that oscillates by a low-voltage output of the electric power generating element 101, signal generating means 103*a* having an oscillating circuit 103*aa* and dividing means 103*ab,* and time display means 103*b* that displays a time on the basis of an output signal of the signal generating means 103*a;* a step-up circuit 104 that inputs an output voltage of the electric power generating element 101 and an output signal of a selecting circuit 107 for stepping up the output voltage of the electric power generating element 101 up to a predetermined voltage to output a step-up voltage to a charging circuit 105; a charging circuit 105 such as a capacitor or a secondary battery which charges an electromotive force therein to output an output voltage to the electric clock movement 103 and the voltage detecting circuit 106; the voltage detecting circuit 106 which inputs an output voltage of the charging circuit 105 for detecting any voltage value to output a detection signal to the low-voltage oscillating circuit 102 and the selecting circuit 107; and the selecting circuit 107 that selects any one of the output signal of the low-voltage oscillating circuit 102 and the output signal of the signal generating means 103*a* in accordance with the output signal of the voltage detecting circuit 106 to output an output signal to the step-up circuit 104.

As the electric power generating element 101, there is used a thermo-element including a plurality of n-type semiconductors and p-type semiconductors connected in series to each other, endothermic-side insulators fixed on every two nodes of the n-type semiconductors and the p-type semiconductors, and heat-radiating-side insulators fixed on every other two nodes of the n-type semiconductors and the p-type semiconductors as shown in FIG. 3. The electric power generating element 101 may be comprised of a thermo-element including at least a pair of n-type semiconductor and p-type semiconductor connected in series.

Also, the electric power generating element 101 may be comprised of another type of electric power generating element such as a solar battery other than the above-described thermo-element.

(First Embodiment)

Figure 4:
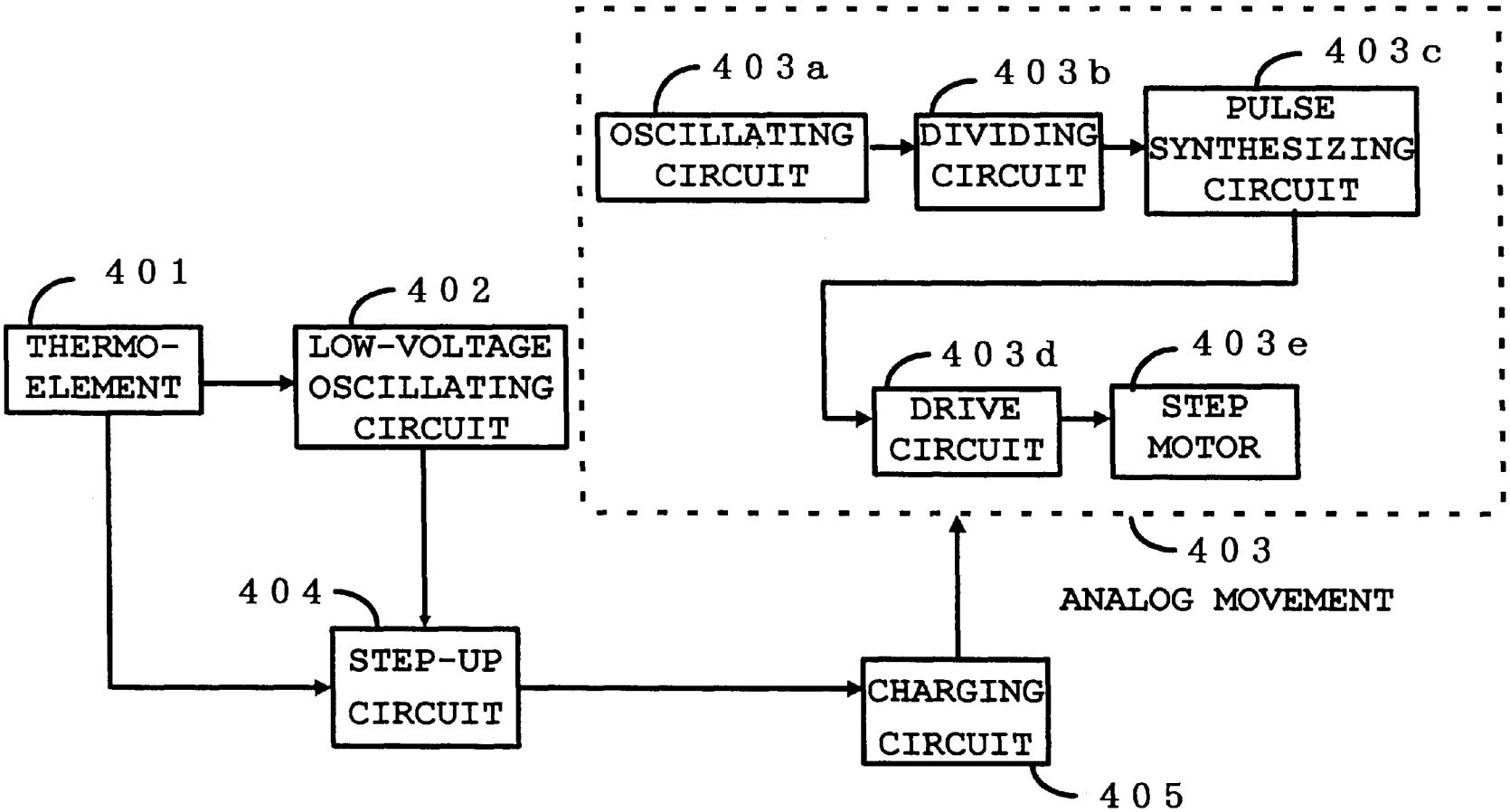
FIG. 4 is a block diagram showing an electronic clock having an electric power generating element as a thermo-element in accordance with a first embodiment of the present invention, employing an analog electronic clock as an electronic clock movement.

Now, a description will be given of a first embodiment in which an electric power generating element is formed of a thermo-element, and the electronic clock movement is formed of an analog movement in an electronic clock in accordance with the above first embodiment mode. FIG. 4 is a block diagram showing the first embodiment.

The structure of FIG. 4 will be described. A thermo-element 401 outputs an output voltage to a low-voltage oscillating circuit 402 and a step-up circuit 404. A low-voltage oscillating circuit 402 inputs an output voltage of the thermo-element 401 to output an output signal to the step-up circuit 404. A dividing circuit 403*b* inputs an output signal of an oscillating circuit 403*a* to output an output signal to a pulse synthesizing circuit 403*c*. A driving circuit 403*d* inputs an output signal of the pulse synthesizing circuit 403*c* to output an output signal to a step motor 403*e*. An analog movement 403 is made up of the oscillating circuit 403*a,* the dividing circuit 403*b,* the pulse synthesizing circuit 403*c,* the driving circuit 403*d* and the step motor 403*e*. The step-up circuit 404 inputs the output voltage of the thermo-element 401 and the output signal of the low-voltage oscillating circuit 402 to output a step-up output to the charging circuit 405. The charging circuit 405 inputs a step-up output of the step-up circuit 404 to output an output voltage to the analog movement 403.

Now, the electric power generating principle of the thermo-element 401 will be described with reference to FIG. 3. Assuming that first insulators 301 are at an endothermic side, and second insulators 302 are at a heat radiating side, in the case where a difference in temperature is given in such a manner that the endothermic side temperature is made higher than a heat-radiating side temperature, a heat is transmitted from the first insulators 301 toward the second insulators 302. In this situation, electrons move toward the heat-radiating side insulators 302 in the respective n-type semiconductors 303. In the respective p-type semiconductors 304, holes move toward the heat-radiating side insulators 302. Because the n-type semiconductors 303 and the p-type semiconductors 304 are electrically connected in series to each other through nodes 305, the transmission of heat is converted into electrical current, thereby being capable of obtaining an electromotive force from both-end output terminal portions 306. For example, when about 1000 semiconductors made of Bismuth tellurium are connected in series to each other, a difference in temperature between the endothermic side and heat-radiating side is one degree, to thereby develop an electromotive force of about 0.2 V.

The low-voltage oscillating circuit 402 is comprised of a ring oscillator circuit in which an odd number of invertors formed of C-MOS transistors are connected in series, and an output signal of an output-stage invertor serves as an input signal of an initial-stage invertor, and an electromotive force obtained by the thermo-element 401 is employed as a power supply.

Figure 5:
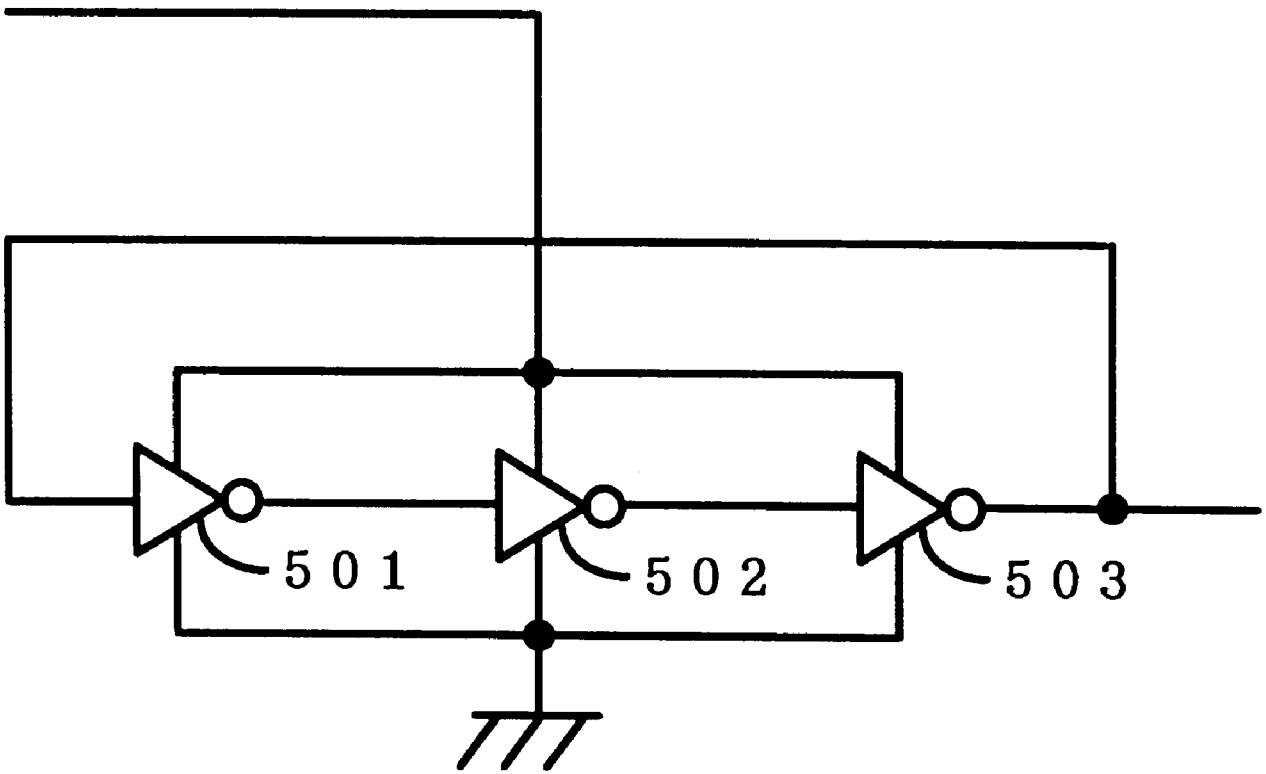
FIG. 5 is a circuit diagram showing one example of a low-voltage oscillating circuit used in the first embodiment of the present invention.

FIG. 5 shows an example in which a ring oscillator circuit in which three invertors are connected in series is used as the low-voltage oscillating circuit 402. An output of a first invertor 501 is connected to an input of a second invertor 502. Also, an output of the second invertor 502 is connected to an input of a third invertor 503. An output of the third invertor 503 is connected to an input of the first invertor 501, and a node between the output of the third invertor 503 and the input of the first invertor 501 forms an output of the low-voltage oscillating circuit 402. One power supply terminals of the first, the second and the third invertors are connected to the output of the thermo-element 401. Those invertors operates with the electromotive force (voltage) obtained by the thermo-element as a power supply. The other power supply terminals of the respective invertors are grounded.

The first invertor 501, the second invertor 502 and the third invertor 503 are made up of C-MOS transistor, respectively. A threshold voltage (Vth) of the invertors is about 0.2 V, and in this situation, the low-voltage oscillating circuit 402 starts oscillation operation when a power supply voltage is about 0.3 V. The oscillation frequency of the ring oscillator circuit can be adjusted by the number (odd number) of invertors connected in series, or by the connection of capacitors between the nodes of the respective invertors and ground. The low-voltage oscillating circuit 402 may be structured by an oscillating circuit that oscillates with a low voltage (electromotive force developed by the electric power generating element) other than the ring oscillator circuit.

The oscillating circuit 403*a* generates a reference signal (clock) of the clock by quartz oscillation (in case of clock oscillation, generally 32 kHz), CR oscillation or the like due to a resistor R and a capacitor C. The dividing circuit 403*b* divides the output signal of the oscillating circuit 403*a*. In the case where a signal of 1 Hz (a period is 1 second) is produced by quartz 32 kHz in frequency, 15 T-flip flops are connected to each other. The pulse synthesizing circuit 403*c* synthesizes a drive pulse, a correction pulse or the like by the output of the dividing circuit 403*b* to selectively output it. The drive circuit 403*d* inputs the output signal of the pulse synthesizing circuit 403*c* to drive the step motor 403*e* consisting of a stator, a rotor and a coil. The analog movement 403 includes the oscillating circuit 403*a,* the dividing circuit 403*b,* the pulse synthesizing circuit 403*c,* the drive circuit 403*d* and the step motor 403*e* as the least structural elements.

The step-up circuit 404 is of the switched capacitor system that inputs the output clock of the low-voltage oscillating circuit 402 with the electromotive force (voltage) developed by the thermo-element 401 as an input voltage and steps it up. Also, the step-up circuit 404 may be a step-up circuit that steps up three times or more because of the relation between the electromotive force obtained by the thermo-element 401 and the drive voltage of the analog movement 403. The charging circuit 405 is formed of a chargeable/dischargeable capacitor, an electric two-layer capacitor, a secondary battery or the like. The threshold voltage (Vth) of the n-MOS transistor and the p-MOS transistor which structure the step-up circuit 404 is set at a value that can satisfy the amplitude range of the output signal of the low-voltage oscillating circuit 402, that is, a threshold voltage (Vth) value that can distinguish "H" and "L" which are output signals of the low-voltage oscillating circuit 402.

The electronic clock shown in FIG. 4 is an embodiment in the case where the analog movement is applied as the electronic clock movement. Alternatively, the present invention can be realized likewise even in a digital movement including the least structural elements consisting of a time arithmetic operation counter, display means such as an LCD or an LED, a display drive circuit and a display constant-voltage circuit as the time display means, or a combination movement where the analog movement and the digital movement are combined.

(Second Embodiment)

Figure 7:
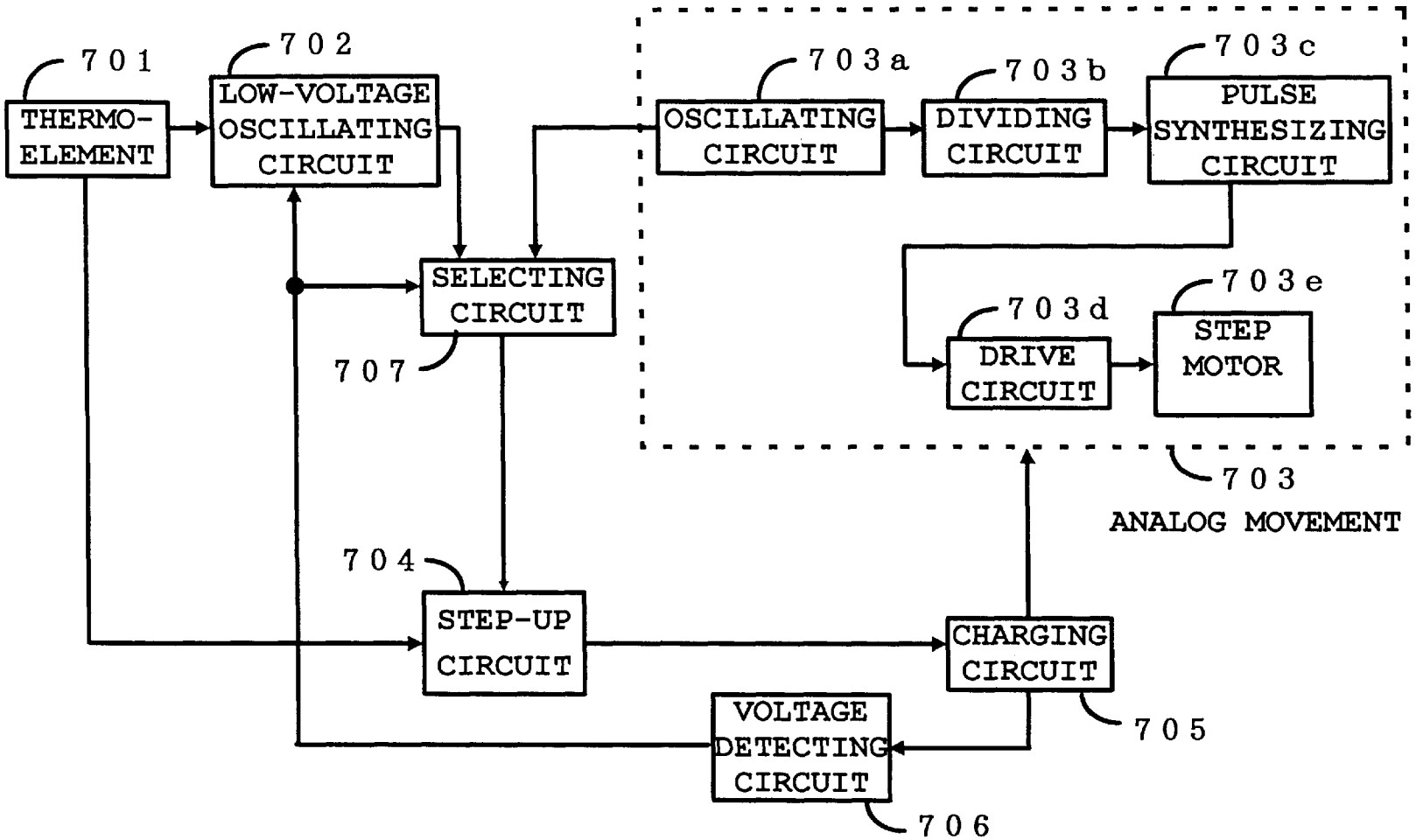
FIG. 7 is a block diagram showing an electronic clock having an electric power generating element as a thermo-element in accordance with a second embodiment of the present invention, employing an analog electronic clock as an electronic clock movement.

Subsequently, a description will be given of a second embodiment in which an electric power generating element is formed of a thermo-element, and the electronic clock movement is formed of an analog movement in an electronic clock in accordance with the above second embodiment mode. FIG. 7 is a block diagram showing the second embodiment.

The structure of FIG. 7 will be described. A thermo-element 701 outputs an output voltage to a low-voltage oscillating circuit 702 and a step-up circuit 704. A low-voltage oscillating circuit 702 inputs an output voltage of the thermo-element 701 and an output signal of a voltage detecting circuit 706 to output an output signal to a selecting circuit 707. A dividing circuit 703*b* inputs an output signal of an oscillating circuit 703*a* to output an output signal to a pulse synthesizing circuit 703*c*. A driving circuit 703*d* inputs an output signal of the pulse synthesizing circuit 703*c* to output an output signal to a step motor 703*e*. An analog movement 703 is made up of the oscillating circuit 703*a,* the dividing circuit 703*b,* the pulse synthesizing circuit 703*c,* the driving circuit 703*d* and the step motor 703*e*. The step-up circuit 704 inputs the output voltage of the thermo-element 701 and the output signal of the selecting circuit 707 to output a step-up voltage to the charging circuit 705. The charging circuit 705 inputs a step-up voltage of the step-up circuit 704 to output an output voltage to the voltage detecting circuit 706 and the analog movement 703. The voltage detecting circuit 706 inputs the output voltage of the charging circuit 705 to output an output signal to the low-voltage oscillating circuit 702 and the selecting circuit 707. The selecting circuit 707 inputs the output signal of the low-voltage oscillating circuit 702, the output signal of the oscillating circuit 703*a* and the output signal of the voltage detecting circuit 706 to output an output signal to the step-up circuit 704.

The low-voltage oscillating circuit 702 is composed of a ring oscillator circuit in which an odd number of invertors formed of C-MOS transistors are connected in series, and an output signal of an output-stage invertor serves as an input signal of an initial-stage invertor, and an electromotive force obtained by the thermo-element 701 is employed as a power supply. Also, the power supply can be turned on/off according to the output signal of the voltage detecting circuit 706.

Figure 8:
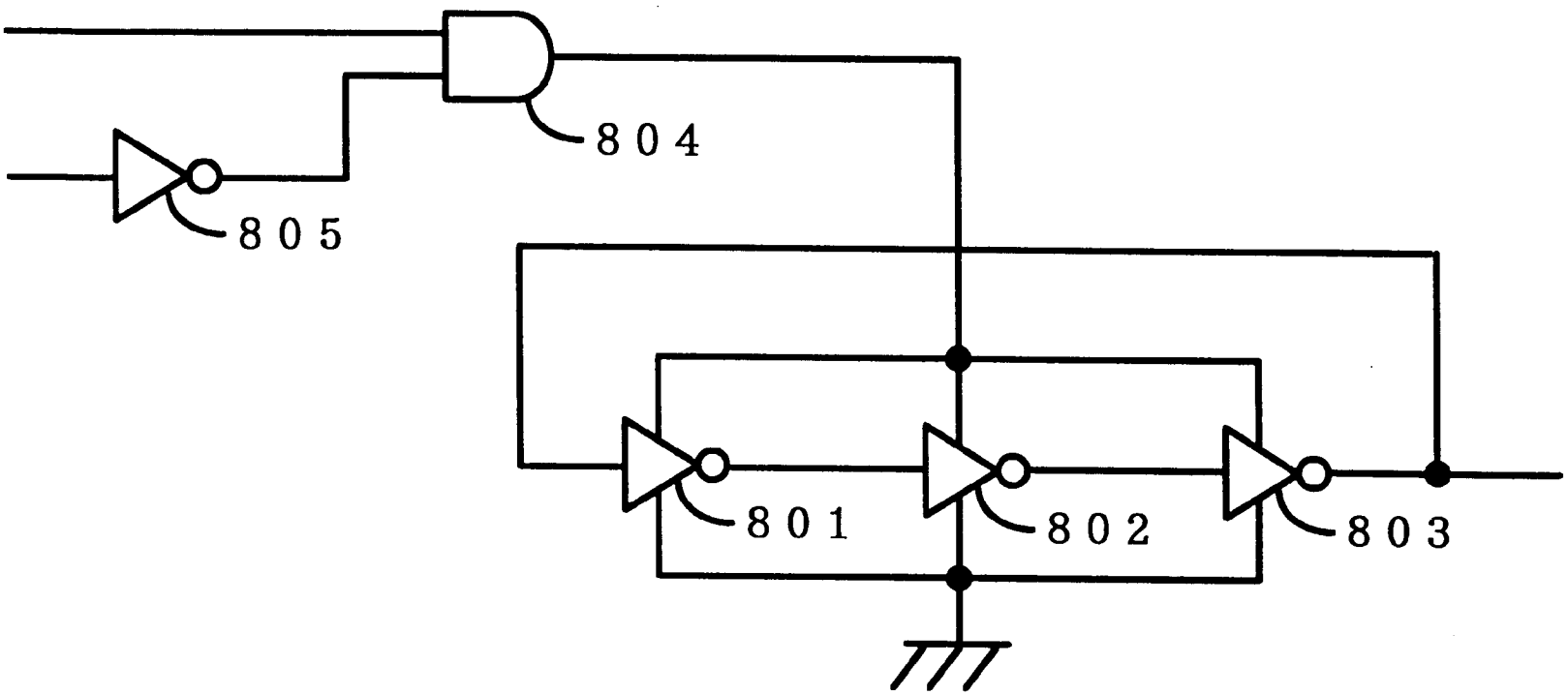
FIG. 8 is a circuit diagram showing one example of a low-voltage oscillating circuit used in the second embodiment of the present invention.

FIG. 8 shows an example in which a ring oscillator circuit in which three invertors are connected in series is used as the low-voltage oscillating circuit 702. An output of a first invertor 801 is connected to an input of a second invertor 802. Also, an output of the second invertor 802 is connected to an input of a third invertor 803. An output of the third invertor 803 is connected to an input of the first invertor 801, and a node between the output of the third invertor 803 and the input of the first invertor 801 forms an output of the low-voltage oscillating circuit 702. One input terminal of a two-input AND circuit 804 inputs the output voltage (electromotive force) of the thermo-element 701. The other input terminal of the two-input AND circuit 804 inputs the output signal of the voltage detecting circuit 706 through the invertor 805. The output of the two-input AND circuit 804 is connected to one power supply terminal of the first, the second and the third invertors.

In the low-voltage oscillating circuit 702 thus structured, when the output signal of the voltage detecting circuit 706 is "L", the output of the thermo-element 701 becomes an output of the two-input AND circuit 804 so that a power is applied to the first, the second and the third invertors to produce oscillation. When the output signal of the voltage detecting circuit 706 is "H", the output of the two-input AND circuit 804 becomes "L" so that the first, the second and the third invertors turn "OFF". In this example, the power supply of the two-input AND circuit 804 is an electromotive force obtained by the thermo-element 701. Also, the other power supply terminals of the respective invertors are grounded.

The first invertor 801, the second invertor 802 and the third invertor 803 are made up of C-MOS transistors, respectively. A threshold voltage (Vth) of the invertors is about 0.2 V, and in this situation, the low-voltage oscillating circuit 702 starts oscillation when a power supply voltage is about 0.3 V. The oscillation frequency of the ring oscillator circuit can be adjusted by the number (odd number) of invertors connected in series, or by the connection of capacitors between the nodes of the respective invertors and ground. The low-voltage oscillating circuit 702 may be structured by an oscillating circuit that oscillates with a low voltage (electromotive force developed by the electric power generating element) other than the ring oscillator circuit.

The oscillating circuit 703*a* generates a reference signal of the clock by quartz oscillation (in case of clock oscillation, generally 32 kHz), or CR oscillation or the like due to a resistor R and a capacitor C. The dividing circuit 703*b* divides the output signal of the oscillating circuit 703*a*. In the case where a signal of 1 Hz (a period is 1 second) is produced by quartz 32 kHz in frequency, 15 T-flip flops are connected to each other. The pulse synthesizing circuit 703*c* synthesizes a drive pulse, a correction pulse or the like by the output of the dividing circuit 703*b* to selectively output it. The drive circuit 703*d* inputs the output signal of the pulse synthesizing circuit 703*c* to drive the step motor 703*e* consisting of a stator, a rotor and a coil. The analog movement 703 includes the oscillating circuit 703*a*, the dividing circuit 703*b*, the pulse synthesizing circuit 703*c*, the drive circuit 703*d* and the step motor 703*e* as the minimum structural elements.

The step-up circuit 704 is of the switched capacitor system that inputs any one of the clock signals from the low-voltage oscillating circuit 702 and the oscillating circuit 703*a* selected by the selecting circuit 707 with the electromotive force (voltage) developed by the thermo-element 701 as an input voltage and steps it up. Also, the step-up circuit 704 may be a step-up circuit that steps up three times or more because of the relation between the electromotive force obtained by the thermo-element 701 and the least drive voltage of the analog movement 703. The charging circuit 705 is formed of a chargeable/dischargeable capacitor, an electric two-layer capacitor, a secondary battery or the like.

The voltage detecting circuit 706 includes a reference voltage generating circuit and a comparator circuit as the minimum structural element and compares the electromotive force charged in the charging circuit 705 with a reference voltage. The comparator circuit outputs "L" when the electromotive force charged in the charging circuit 705 is lower than the reference voltage, and outputs "H" when the electromotive force charged in the charging circuit 705 is equal to or higher than the reference voltage. The selecting circuit 707 outputs the output signal of the low-voltage oscillating circuit 702 to the step-up circuit 704 when the output of the voltage detecting circuit 706 is "L", and outputs the output signal of the oscillating circuit 703*a* to the step-up circuit 704 when the output of the voltage detecting circuit 706 is "H".

Figure 9:
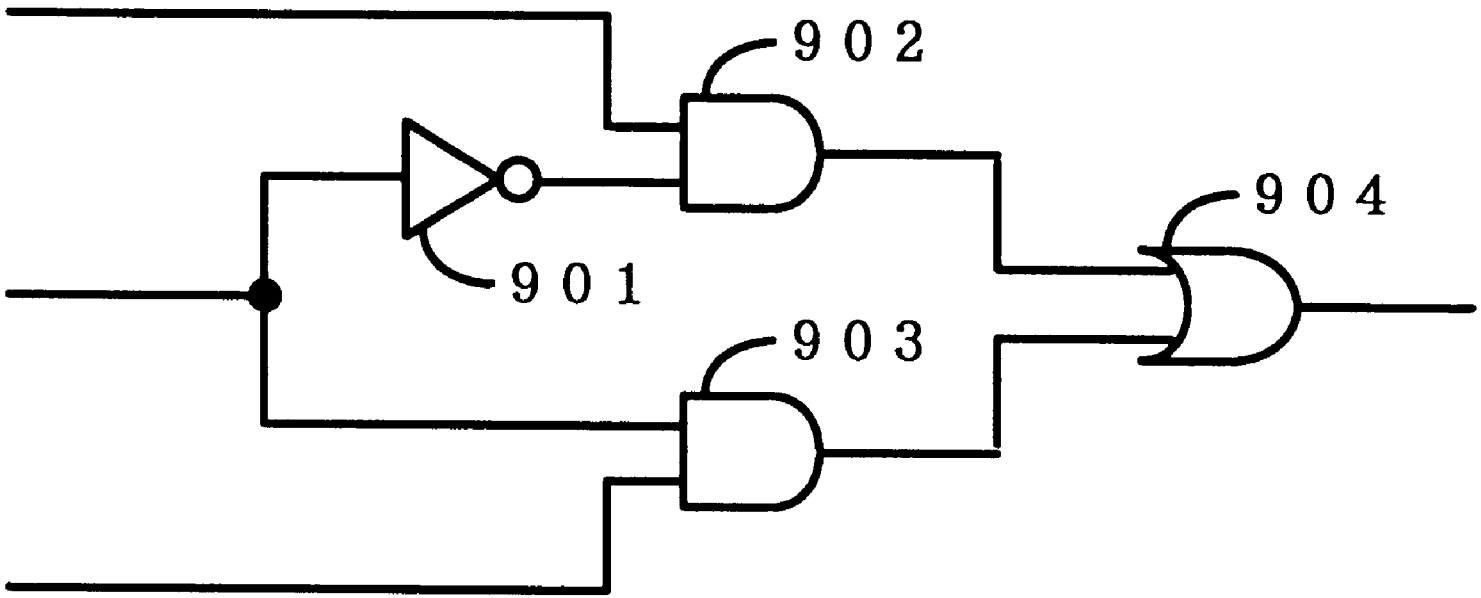
FIG. 9 is a circuit diagram showing one example of a selecting circuit used in the second embodiment of the present invention.

FIG. 9 shows an example of the selecting circuit 707. The selecting circuit 707 is made up of two AND circuits (902, 903), one OR circuit (904) and one invertor (901). The output signal of the voltage detecting circuit 706 is connected to one input terminal of the two-input AND circuit 902 through the invertor 901. Also, the output signal of the voltage detecting circuit 706 is connected to one input terminal of the two-input AND circuit 903. The output signal of the low-voltage oscillating circuit 702 is connected to the other input terminal of the two-input AND circuit 902, and the output signal of the oscillating circuit 703*a* is connected to the other input terminal of the two-input AND circuit 903. The two-input OR circuit 904 inputs the output signal of the two-input AND circuit 902 and the output signal of the two-input AND circuit 903 to output these signals to the step-up circuit 704. In this example, the threshold voltage (Vth) of the n-MOS transistor and the p-MOS transistor which structure the step-up circuit 704 and the selecting circuit 707 is set at a value that can satisfy both of the amplitude range of the output signal of the low-voltage oscillating circuit 702 and the amplitude range of the output signal of the oscillating circuit 703*a*, that is, a threshold voltage (Vth) value that can output "H" and "L" which are output signals of the low-voltage oscillating circuit 702, and "H" and "L" which are output signals of the oscillating circuit 703*a* to the step-up circuit 704 without any detection errors.

The electronic clock shown in FIG. 7 is an embodiment in the case where the analog movement is applied as the electronic clock movement. Alternatively, the present invention can be realized likewise even in a digital movement including the minimum structural elements consisting of a time arithmetic operation counter, display means such as an LCD or an LED, a display drive circuit and a display constant-voltage circuit as the time display means, or a combination movement where the analog movement and the digital movement are combined.

Also, in the embodiment shown in FIG. 7, the input signal of the selecting circuit 707 from the analog movement 703 side serves as the output signal of the oscillating circuit 703*a*. Alternatively, the present invention can be realized likewise even in the case where the output signal of the dividing circuit 703*b* or the pulse synthesizing circuit 703*c* that synthesizes the output signal of the dividing circuit 703*b* serves as the input signal of the selecting circuit 707.

The electronic clock according to the present invention is arranged in such a manner that the low-voltage oscillating circuit that can oscillate even when a power supply voltage is low is provided, and charging is made by an oscillation signal of the oscillating circuit. For that reason, even when the electromotive force obtained by the electric power generating element is a low voltage, since the electronic clock can be operated, a large number of electric power generating elements need not to be connected in series, thereby being capable of realizing the downsizing of the electronic clock.

Also, under circumstances where the electromotive force obtained by the electric power generating element is small when the electronic clock is used, for example, under the circumstances such as the inside an office where illumination is relatively low when a solar battery is employed as the electric power generating element, or under the circumstances of midsummer where a difference in temperature between an external air temperature and a human body temperature is difficult to obtain when a thermo-element is applied, the oscillation starting time (a time until the clock starts to operate) can be reduced even in a state where there is no charging capacitance of the charging circuit, and the electronic clock can be used soon when the user wants to use it.

Further, the electronic clock according to the present invention provides the voltage detecting circuit and the selecting circuit in addition to the above structure. In this structure, a voltage value higher than the voltage value with which the oscillation of the signal generating means can be maintained is set on the reference voltage of the voltage detecting circuit, and when the electromotive force more than the reference voltage value is charged, the operation of the low-voltage oscillating circuit is allowed to stop. As a result, the current consumption including current leakage can be reduced, and the electromotive force obtained by the electric power generating element can be charged in the charging circuit as much.

What is claimed is:

1. An electronic clock having an electric power generating element, comprising:

clock signal generating means for generating a divided clock signal and having an oscillating circuit for producing a clock signal and dividing means for dividing the clock signal and producing the divided clock signal;

an electronic clock movement having time display means for displaying time on the basis of the divided clock signal output by the clock signal generating means;

an electric power generating element for generating electric power in response to at least one of incident light and heat;

a low-voltage oscillating circuit which oscillates in accordance with an output voltage of the electric power generating element;

a step-up circuit which inputs the output voltage of the electric power generating element and an output signal of the low-voltage oscillating circuit for stepping up the output voltage of the electric power generating element to a predetermined voltage level to output a stepped-up output signal; and a charging circuit for charging by the stepped-up output signal of the step-up circuit to supply a charged stepped-up output signal to the electronic clock movement.

2. An electronic clock having an electric power generating element comprising:

clock signal generating means for generating a divided clock signal and having an oscillating circuit for producing a clock signal and dividing means for dividing the clock signal and producing the divided clock signal;

an electronic clock movement having time display means for displaying time on the basis of the divided clock signal output by the clock signal generating means;

an electric power generating element for generating electric power in response to at least one of incident light and heat;

a low-voltage oscillating circuit which oscillates in accordance with an output voltage of the electric power generating element;

a voltage detecting circuit which inputs an output voltage of a charging circuit for detecting a predetermined voltage value and outputting a detection signal to the low-voltage oscillating circuit and to a selecting circuit;

the selecting circuit for inputting the detection signal output by the voltage detecting circuit, selecting one of the output signal of the low-voltage oscillating circuit and the output signal of the signal generating means, and outputting an output signal to a step-up circuit;

the step-up circuit for inputting the output voltage of the electric power generating element and the output signal of the selecting circuit for stepping up the output voltage of the electric power generating element to a predetermined voltage level to output a stepped-up output; and a charging circuit for charging by the stepped-up output of the step-up circuit to supply a charged stepped-up output to the electronic clock movement.

3. An electronic clock having an electric power generating element according to any one of claims 1 and 2; wherein the low-voltage oscillating circuit comprises a low-voltage oscillating circuit which oscillates at a voltage lower than the signal generating means.

4. An electronic clock having an electric power generating element according to claim 2; wherein the low-voltage oscillating circuit comprises an oscillating circuit which oscillates at a voltage lower than the signal generating means; the voltage detecting circuit comprises a circuit which detects whether the output voltage of the charging circuit is at a voltage level at which the signal generating means is operable, or at a higher voltage level, and outputs a corresponding detection signal; and the selecting circuit comprises a circuit which outputs the output signal of the low-voltage oscillating circuit when the detection signal is not input to the selecting circuit, and which outputs the output signal of the signal generating means when the detection signal is input to the selecting circuit.

5. An electronic clock having an electric power generating element according to any one of claims 1 and 2; wherein the electric power generating element comprises a thermo-element including at least a pair of n-type semiconductor and p-type semiconductor elements connected in series to each other.

6. An electronic clock having an electric power generating element as claimed in any one of claims 1 and 2; wherein the electric power generating element comprises a thermo-element including a plurality of n-type semiconductor elements and p-type semiconductor elements connected in series to each other, endothermic-side insulators fixed to every two nodes of the n-type semiconductors and the p-type semiconductor elements, and heat-radiating-side insulators fixed to every other two nodes of the n-type semiconductor elements and the p-type semiconductor elements.

* * * * *